US011697074B1

(12) United States Patent
Grinsell et al.

(10) Patent No.: US 11,697,074 B1
(45) Date of Patent: Jul. 11, 2023

(54) STACKABLE MODEL

(71) Applicant: THE MARKETING STORE WORLDWIDE, LP, Chicago, IL (US)

(72) Inventors: Peter Grinsell, Surrey (GB); Ming Tang, Kent (GB); Mitzi De Castro, London (GB); Evangelos Gicas, Croydon (GB)

(73) Assignee: The Marketing Store Worldwide, LP, Chicago, IL (US)

( * ) Notice: Subject to any disclaimer, the term of this patent is extended or adjusted under 35 U.S.C. 154(b) by 0 days.

(21) Appl. No.: 17/505,593

(22) Filed: Oct. 19, 2021

(51) Int. Cl.
*A63H 3/16* (2006.01)
*A63H 9/00* (2006.01)

(52) U.S. Cl.
CPC ..... *A63H 3/16* (2013.01); *A63H 9/00* (2013.01)

(58) Field of Classification Search
CPC . A63H 3/16; A63H 9/00; A63H 33/04; G09B 19/10
See application file for complete search history.

(56) References Cited

U.S. PATENT DOCUMENTS 2,493,697 A * 1/1950 Raczkowski ..... A63F 9/12 273/156
2,725,234 A * 11/1955 Johnd ..... A63F 9/1288 273/157 R
4,464,214 A 8/1984 Tsuchie
5,396,713 A * 3/1995 Valdez ..... B43L 13/20 428/53
5,683,086 A 11/1997 Druckman et al.
5,700,177 A * 12/1997 Lemelson ..... A63F 9/12 273/156
5,810,357 A * 9/1998 Brink ..... A63F 9/1288 273/156
6,089,949 A * 7/2000 Resper ..... A63H 3/02 446/374
D480,116 S * 9/2003 Collins ..... D21/479
9,346,136 B2 5/2016 Kim
2011/0174126 A1* 7/2011 Rauch ..... G02F 1/13718 83/23

FOREIGN PATENT DOCUMENTS

GB 2422556 B 8/2006

* cited by examiner

*Primary Examiner* — John A Ricci
(74) *Attorney, Agent, or Firm* — Reed Smith LLP; Matthew P. Frederick

(57) ABSTRACT

A model toy with stackable elements. The stackable elements are unitary layers which are attached to one another behind a front plate. The front plate has guide tabs to be threaded through openings in each of the unitary layers. The end of each guide tab is affixed to the last of the unitary layers.

20 Claims, 9 Drawing Sheets

STACKABLE MODEL

FIELD OF THE INVENTION

The present invention is directed to stackable models and methods of assembly thereof.

BACKGROUND OF THE INVENTION

Models that are built by stacking layers in a prearranged order are known, but existing models can be complex, particularly for children. For example, known methods of making a model with multiple layers are shown in U.S. Pat. No. 9,346,136; U.S. Pat. No. 5,683,086; U.S. Pat. No. 5,568,086; and UK Patent GB 2,422,556. The present disclosure is directed to stackable toys with one or more features for improving ease of assembly, ergonomics, aesthetics, enjoyment, and the like, and may incorporate environmentally-friendly materials. SUMMARY

OF THE INVENTION

In embodiments, a model comprising a plurality of unitary layers, a front plate, and a sticker. The plurality of unitary layers comprises an end layer and a plurality of intermediate layers. The end layer comprises a first opening and a second opening. The plurality of intermediate layers comprises a first intermediate layer and a second intermediate layer. The first intermediate layer comprises a first opening comprising a first length, a second opening comprising a second length greater than the first length, and a first band comprising a first color surrounding each of the first opening and the second opening. The second intermediate layer comprises a first opening comprising the first length, a second opening comprising a second length, and a second band comprising a second color surrounding each of the first opening and the second opening of the second intermediate layer. The second length of the second opening of the second intermediate layer is less than the second length of the second opening of the first intermediate layer and is equal to or longer than the first length of the first opening of the second intermediate layer. The front plate comprises a base plate, a first guide tab comprising a length substantially equal to the first length, and a stepped second guide tab. The stepped second guide tab comprises a first step and a second step. The first step comprises a length substantially equal to the second length of the second opening of the first intermediate layer and the first color. The second step comprises a length substantially equal to the second length of the second opening of the second intermediate layer and the second color. The first guide tab and the stepped second guide tab are configured to be bent 90 degrees from a plane of the front plate. The first and second openings of the end layer and each intermediate layer are configured to align, respectively, with the first guide tab and stepped second guide tab when the first guide tab and stepped second guide tab are bent 90 degrees from a plane of the front plate. The guide tabs comprise a depth configured to simultaneously extend through the openings of the plurality of intermediate layers and the end player. After the guide tabs extend through the openings, the guide tabs further comprise end portions extending beyond the end layer. The sticker is configured to cover the end portions of the guide tabs after they are folded over on the end layer. The sticker fixes the end portions of the guide tabs substantially flat on the end layer.

In embodiments, the base plate of the front plate depicts a face of a character. In embodiments, the first guide tab extends from the front plate and stepped second guide tab extend from the front plate such that when bent 90 degrees from a plane of the front plate, the first guide tab and the stepped second guide tab define intersecting planes.

In embodiments, the front plate comprises a first arm and a second arm. The first arm is located between the base plate and the first guide tab. The first arm comprises a first joint between the first arm and the front plate and a second joint between the first arm and the first guide tab. The second arm is located between the base plate and the stepped second guide tab. The second arm comprises a first joint between the second arm and the front plate and a second joint between the second arm and the stepped second guide tab.

In embodiments, when the first guide tab and stepped second guide tab are bent 90 degrees from the plane of the front plate, and the first arm and second arm are folded flush with the front plate, the first arm lies substantially in a first plane and the second arm lies substantially in a second plane, the first and second planes intersecting at an angle from about 10 degrees to about 90 degrees.

In embodiments, when the front plate is attached to the first intermediate layer, the front plate is separated by a gap from the first intermediate layer, the gap comprising a quadrilateral formed by the first arm, the second arm, the front plate, and the first intermediate layer.

In embodiments, the gap is equal to or greater than the thickness of the first intermediate layer. In embodiments, the plurality of intermediate layers further comprises a third intermediate layer comprising a first opening comprising the first length, a second opening comprising a second length, and a third band comprising a third color surrounding each of the first opening and the second opening. The second length of the second opening is greater than the first length of the first opening.

In embodiments, the stepped second guide tab further comprises a third step comprising a length substantially equal to the second length of the second opening of the third intermediate layer and the third color.

In embodiments, the plurality of intermediate layers further comprises a fourth intermediate layer comprising a first opening comprising the first length, a second opening comprising a second length greater than the first length, and a fourth band comprising a fourth color surrounding each of the first opening and the second opening.

In embodiments, the stepped second guide tab further comprises a fourth step comprising a length substantially equal to the second length of the second opening of the fourth intermediate layer, and the fourth color. In embodiments, there are at least ten unitary layers. In embodiments, the first guide tab comprises a constant length up to the end portion of the first guide tab.

In embodiments, the assembly of the model comprises the steps of preparing the front plate, mounting the plurality of unitary layers on the front plate, bending the end portion of the first guide tab to be substantially flat with the end layer, bending the end portion of the stepped second guide tab to be substantially flat with the end layer, and affixing the end portion of the guide tabs in a way that maintains the end portions in a flush configuration with the end layer. The first guide tab comprises a first length. The stepped second guide tab comprises a first step comprising a first length and the first color and a second step comprising a second length. Preparing the front plate comprises the steps of bending the first guide tab of the front plate to a position forming a 90 degree angle from a plane of a base plate of the front plate and bending a stepped second guide tab of the front plate to a position forming a 90 degree angle from the plane of the front plate. The plurality of unitary layers comprises a first intermediate layer comprising a first opening of a first length substantially equal to the first length of the first step, a second opening of a second length substantially equal to the first length of the second step, and a first band comprising a first color. The plurality of unitary layers comprises a second intermediate layer comprising a first opening of a first length substantially equal to the first length of the first step, a second opening of a second length substantially equal to the second length of the second step, and a second band comprising a second color. The plurality of unitary layers comprises an end layer comprising a first opening of a first length and a second opening. Mounting the plurality of unitary layers on the front plate comprises the steps of threading the first guide tab through the first opening of the first intermediate layer, threading the stepped second guide tab through the second opening of the first intermediate layer, sliding the first intermediate layer toward the front plate along the first guide tab and the stepped second guide tab. Mounting the plurality of unitary layers further comprises threading the first guide tab through the first opening of the second intermediate layer, threading the stepped second guide tab through the second opening of the second intermediate layer, and sliding the second intermediate layer along the first guide tab and stepped second guide tab. Mounting the plurality of unitary layers further comprises threading the first guide tab through the first opening of the end layer, threading the stepped second guide tab through the second opening of the end layer, and sliding the end along the first guide tab and stepped second guide tab.

In embodiments, the first guide tab and stepped second guide tab define intersecting planes when bent 90 degrees from the front plate. In embodiments, the front plate further comprises a first arm located between the base plate and the first guide tab. The first arm comprises a first joint between the first arm and the front plate and a second joint between the first arm and the first guide tab. The second arm is located between the front plate and the stepped second guide tab. The second arm comprises a first joint between the second arm and the front plate and a second joint between the second arm and the stepped second guide tab. Preparing the front plate further comprises, bending the arm at the first joint, positioning the first arm flush with the front plate, bending the first arm at its second joint, bending the second arm at its first joint, positioning the second arm flush with the front plate, and bending the second arm at its second joint.

In embodiments, the first guide tab further comprises a third color zone comprising the third color. In embodiments, the plurality of unitary layers further comprises a third intermediate layer. The third intermediate layer comprises a first opening of a first length substantially equal to the first length of the first intermediate layer, a second opening of a second length substantially equal to the third length of the third step, and a third band comprising the third color. Mounting the plurality of unitary layers comprises threading the first guide tab through the first opening of the third intermediate layer, threading the stepped second guide tab through the second opening of the third intermediate layer, and sliding the third intermediate layer along the first guide tab and stepped second guide tab.

In embodiments, mounting the plurality of unitary layers further comprises threading the first guide tab through the first opening of the fourth intermediate layer, threading the stepped second guide tab through the second opening of the fourth intermediate layer, and sliding the fourth intermediate layer along the first guide tab and stepped second guide tab.

In embodiments, the stepped second guide tab further comprises a fourth step comprising a fourth length. In embodiments, the plurality of unitary layers further comprises a fourth intermediate layer. The fourth intermediate layer comprises a first opening of a first length substantially equal to the first length of the first intermediate layer, a second opening of a second length substantially equal to the fourth length of the fourth step, and a fourth band comprising the fourth color. Mounting the plurality of unitary layers comprises threading the first guide tab through the first opening of the fourth intermediate layer, threading the stepped second guide tab through the second opening of the fourth intermediate layer, and sliding the fourth intermediate layer along the first guide tab and stepped second guide tab.

BRIEF DESCRIPTION OF THE DRAWINGS

The invention can be completely understood in consideration of the following detailed description of various embodiments of the invention in connection with the accompanying drawings, in which.

Figure 1:
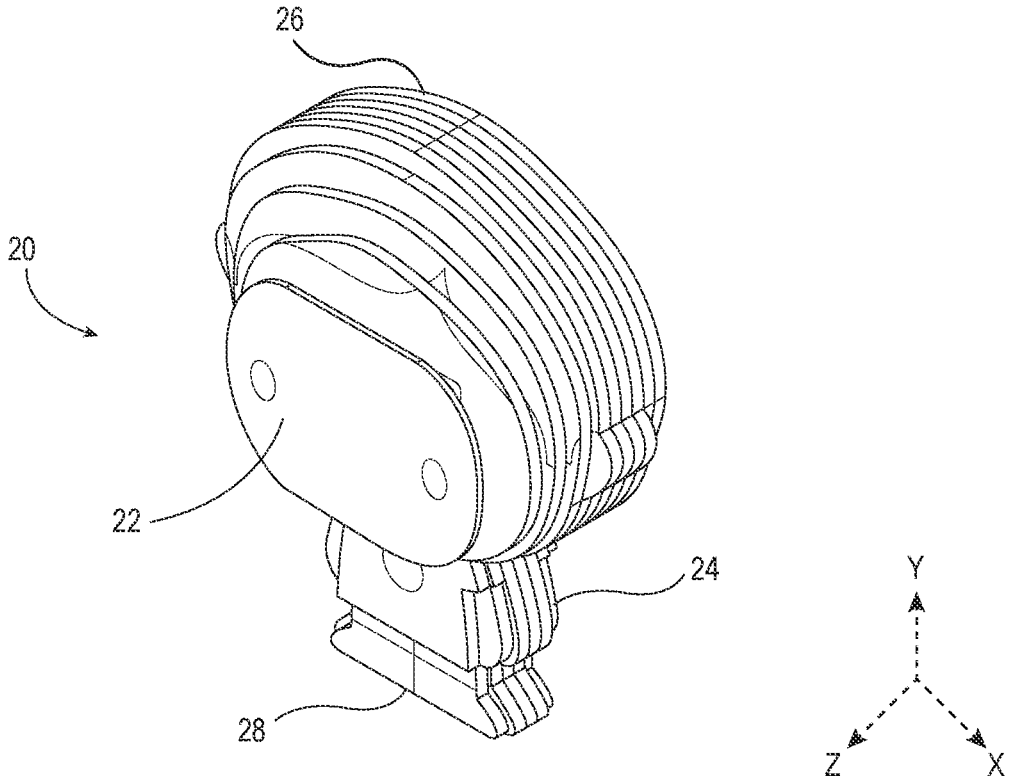
FIG. 1 is a front perspective view of a model according to embodiments of the present disclosure.
Figure 2:
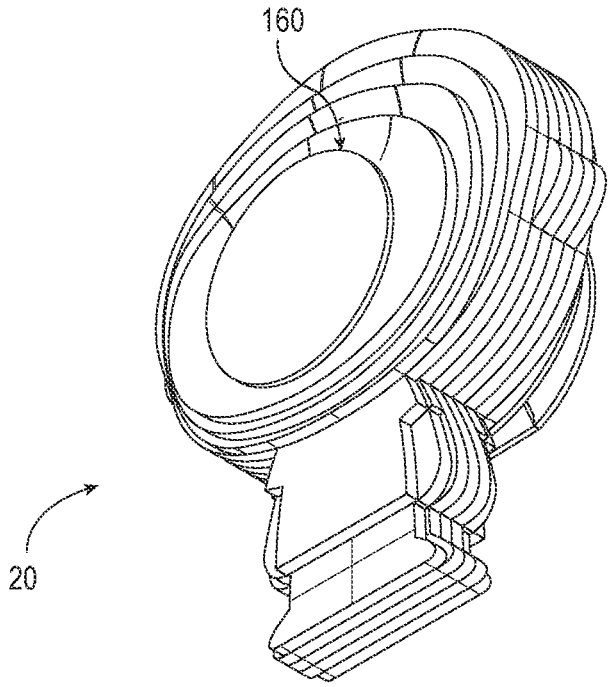
FIG. 2 is a rear perspective view of the model of FIG. 1.
Figure 3:
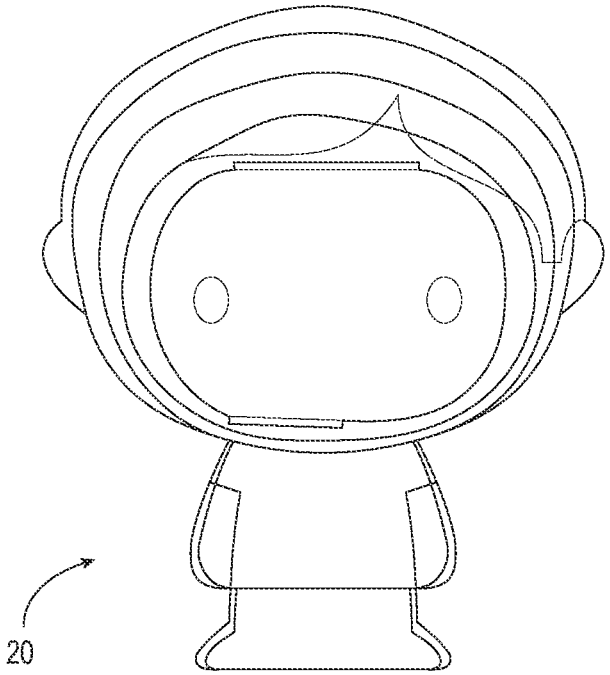
FIG. 3 is a front view of the model of FIG. 1.
Figure 4:
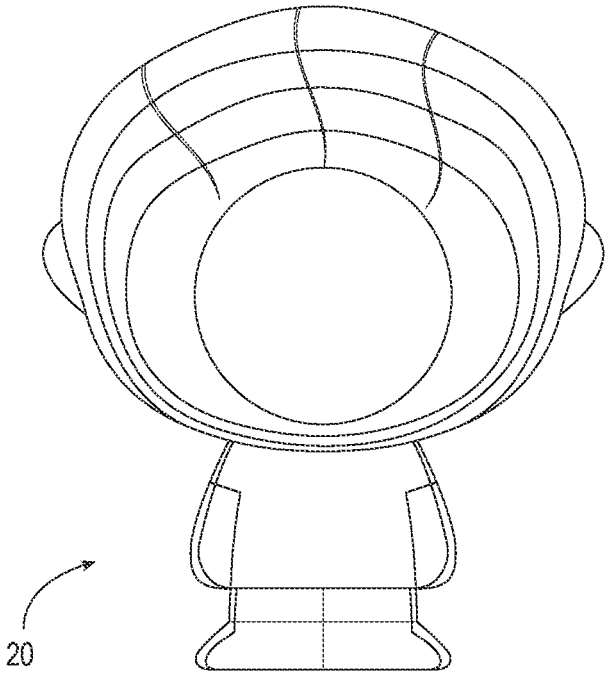
FIG. 4 is a rear view of the model of FIG. 1.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

FIGS. 1-16 show a stackable model 20 according to embodiments of the present disclosure. Referring to FIGS. 1-5, in embodiments the stackable model 20 comprises a front side 22 and a rear side 24 oriented along a z-axis and a top side 26 and a bottom side 28 oriented along a y-axis. The stackable model 20 depicts a figure formed by a stack of layers. In embodiments, the figure formed by the model 20 is a human figure. In other embodiments the model 20 may depict any desired figure, such as an animal, vehicle, building, word(s), letter(s), decoration, symbol, and the like.

Figure 6:
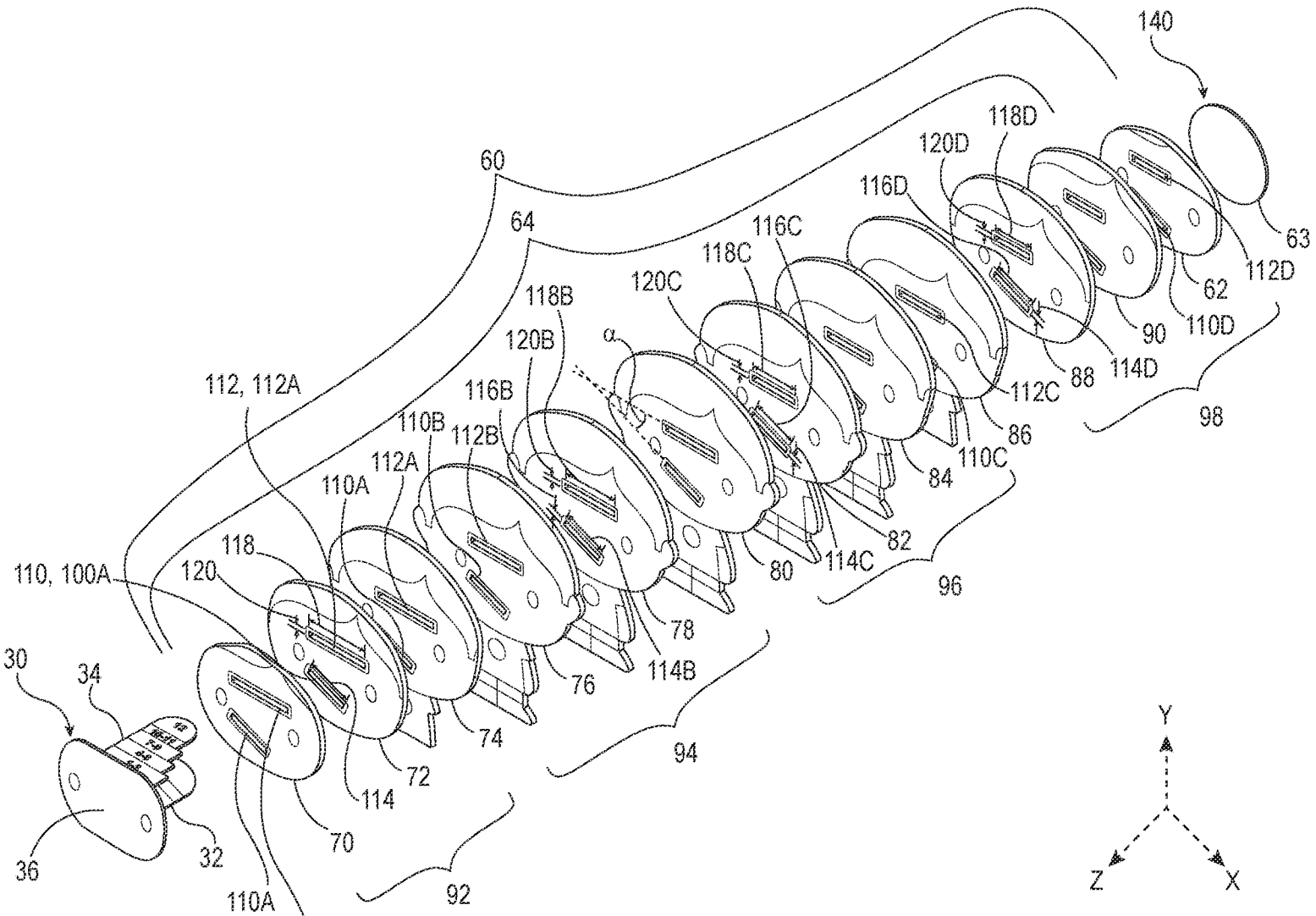
FIG. 6 is a front perspective exploded view of the model of FIG. 1.
Figure 7:
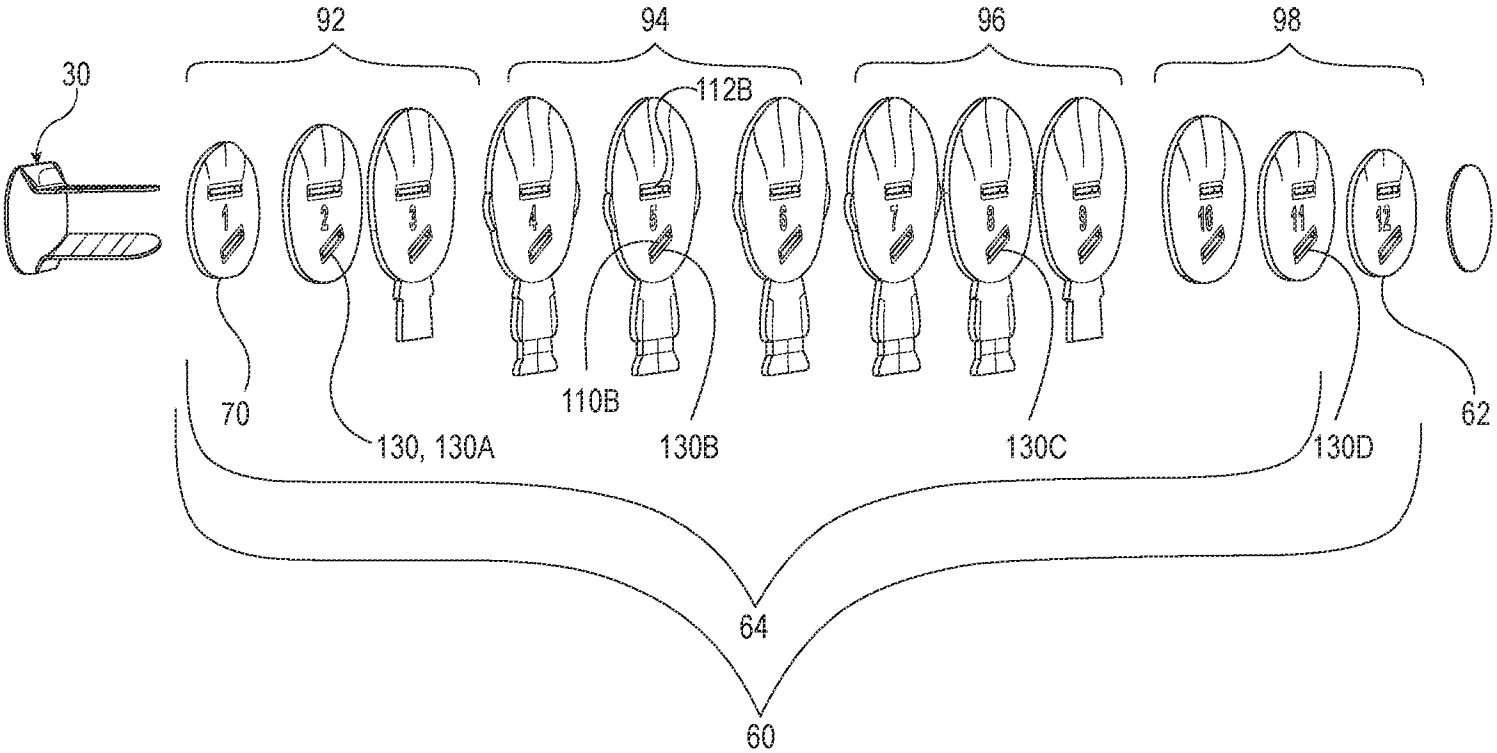
FIG. 7 is a rear perspective exploded view of the model of FIG. 1
Figure 10:
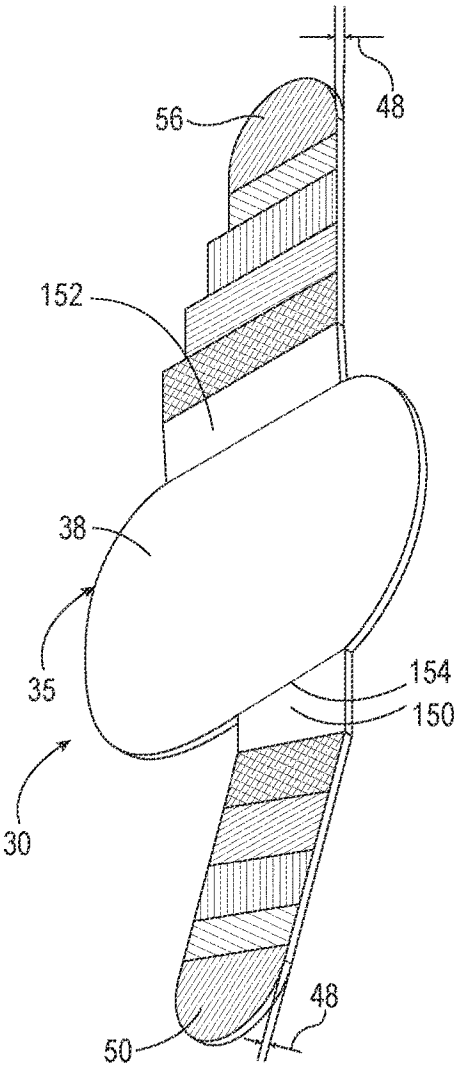
FIGS. 10-13 are each a rear perspective view of the front plate of FIG. 8 shown in various stages of folding.
Figure 9:
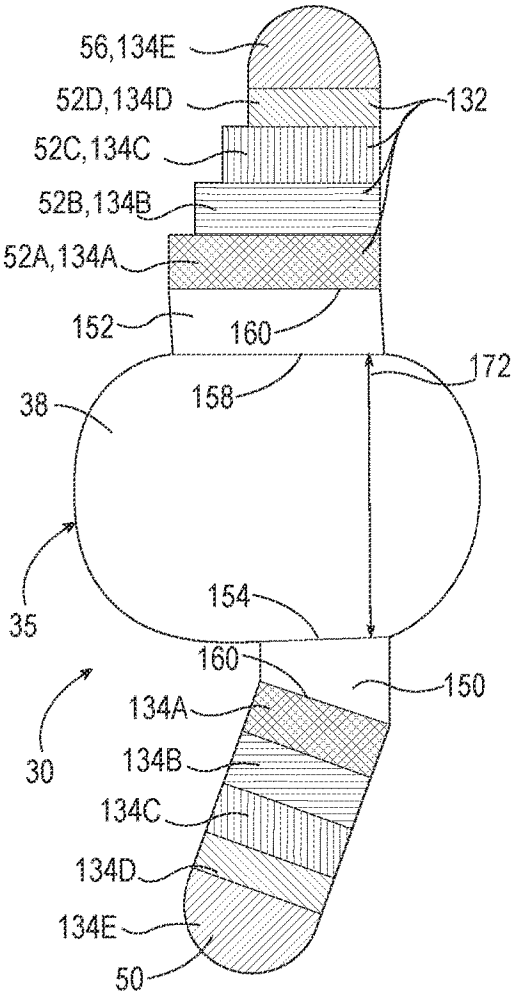
FIG. 9 is a rear view of the front plate of FIG. 8.
Figure 8:
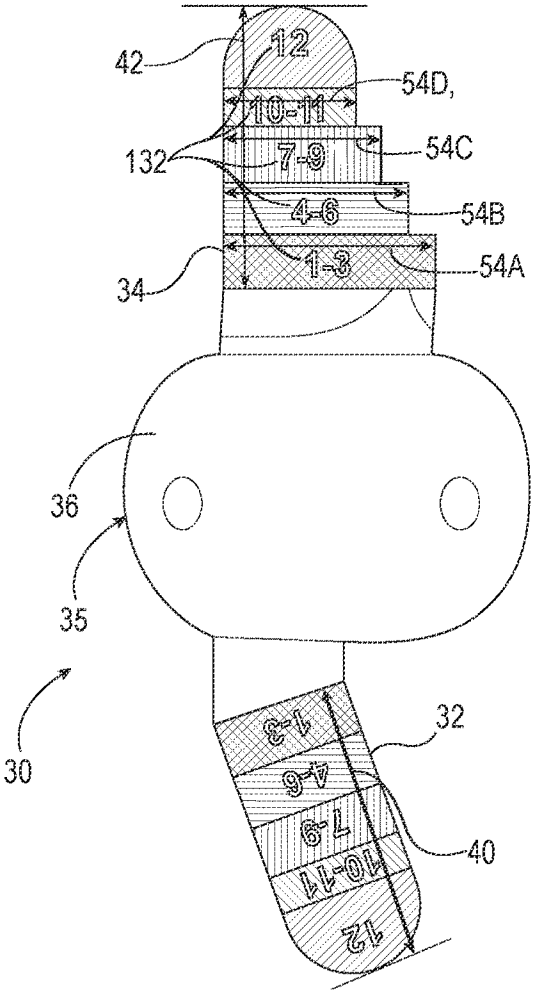
FIG. 8 is a front view of a front plate of the model of FIG. 1 according to embodiments of the present disclosure.
Figure 11:
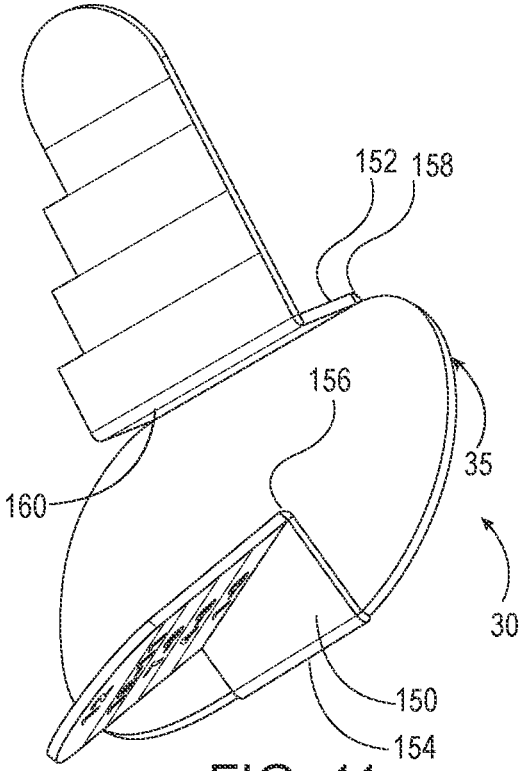
Figure 12:
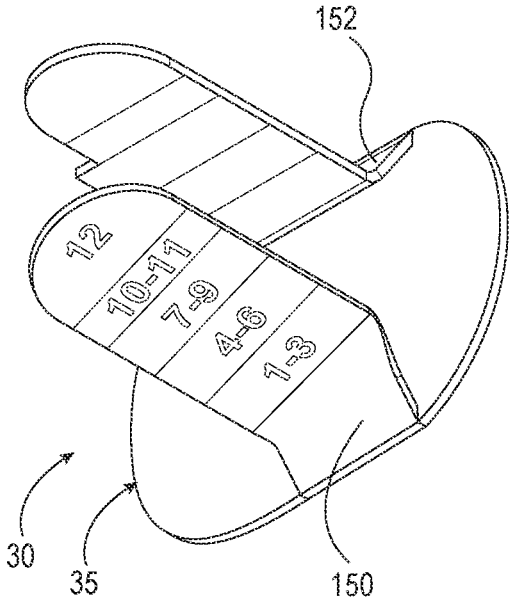

Referring to FIGS. 6-7, one embodiment of a model 20 is shown comprising a front plate 30 and a plurality of unitary layers 60 for stacked assembly. In this embodiment, each layer of the plurality of unitary layers 60 is mounted to the front plate 30 by threading two guide tabs 32, 34 of the front plate 30 through each unitary layer, and then securing the tabs 32, 34 at an end layer 62. In certain embodiments, the guide tabs 32, 34 are secured by a sticker 63.

In certain embodiments, the plurality of unitary layers 60 comprises an end layer 62 and a plurality of intermediate layers 64. In these embodiments, "unitary" means that each of the plurality of unitary layers 60 comprises a singular piece. In other words, each layer is one piece, and not made of multiple separable pieces. In certain embodiments, unitary means that each layer is inseparable and made of a single piece of source material, e.g. cardboard, paperboard, plastic, or other biodegradable material or recyclable material. In embodiments using cardboard, for example, the cardboard source material itself may be made up of several layers that are adhered together, however, each unitary layer of the plurality of unitary layers 60 is a layer made from a single piece of cardboard. In certain embodiments, the unitary layers are made of a substantially rigid material, for example, cardboard, paperboard, plastic sheets, or other biodegradable material or recyclable material.

In certain embodiments, the plurality of intermediate layers 64 are contained in the model 20 between the front plate 30 and the end layer 62. In certain embodiments, the plurality of unitary layers 60 comprise substantially flat pieces of material. In other embodiments, the plurality of unitary layers 60 comprise a piece of material that is not flat. The plurality of unitary layers 60 can be of varying dimensions when assembled and viewed from the front; as shown in FIG. 1-7, a height in the y-dimension and a width in the x-direction may vary for each layer. In certain embodiments, these varying dimensions of the plurality of unitary layers 60 can form the three-dimensional appearance of the model 20. In the illustrated embodiment, the plurality of unitary layers 60 have a consistent or substantially equal thickness in the z-direction shown in FIG. 1. In other embodiments, one or more of the plurality of unitary layers 60 has varying thicknesses.

In some embodiments, the plurality of intermediate layers 64 comprises at least a first intermediate layer 70, 72, 74, 76, 78, 80, 82, 84, 86, 88, and/or 90 and a second intermediate layer 72, 74, 76, 78, 80, 82, 84, 86, 88, 90, and/or 62. In some embodiments, the first intermediate layer 70, 72, 74 is part of a first group of intermediate layers 92. For example, in the embodiment in FIGS/6-7, a first group of intermediate layers 92 comprises three intermediate layers 70, 72, 74. Similarly, in some embodiments, a second group of intermediate layers 94 comprises three intermediate layers 76, 78, 80. Other embodiments can include more than two intermediate layers, or more than two groups of intermediate layers. For the embodiment shown in FIGS. 6-7, a third group of intermediate layers 96 comprises intermediate layers 82, 84, 86 and a fourth group of intermediate layers 98 comprises intermediate layers 88, 90, 62. In some embodiments, the number of intermediate layers in a group of intermediate layers varies for different groups of the model 20.

In some embodiments, the plurality of intermediate layers 64 comprises at least four unitary intermediate layers 70, 72, 74, 76, 78, 80, 82, 84, 86, 88, 90, and/or 62. In other embodiments, the plurality of intermediate layers 64 comprises at least four, at least five, at least six, at least seven, at least eight, at least nine, at least ten, at least eleven, at least twelve, or more unitary intermediate layers 70, 72, 74, 76, 78, 80, 82, 84, 86, 88, 90, and/or 62. The embodiment shown in FIGS. 1-7, for example, has twelve intermediate unitary layers 70, 72, 74, 76, 78, 80, 82, 84, 86, 88, 90, 62.

In certain embodiments, each layer of the plurality of unitary layers 60 comprises a first opening 110 and a second opening 112, the first opening 110 defining a first length 114 and a first width 116 and the second opening 112 defining a second length 118 and a second width 120. In other embodiments, the intermediate layers and end layer 62 can each have one opening, three openings or more. In these embodiments, the openings can be of the same or different length.

In the embodiment shown in FIGS. 1-7, the first opening 110A of layer(s) of the first group of intermediate layers 92 comprises a first length 114A. The second opening 112A comprises a second length 118A greater than the first length 114A. In some embodiments, having openings of different lengths can correspond to guide tabs 32, 34 of different lengths, and act as a guide in assembling the model. In some embodiments, one of the openings 110, 112 in each intermediate layer or end layer 62 can be the same length, e.g. the first opening 110A, 110B, 110C, 110D, can be the same first length 114A, 114B, 114C, 114D for all of the plurality of intermediate layers 64 and the end layer 62. In those embodiments, the second opening 112A, 112B, 112C, 112D can be the same second length 118A, 118B, 118C, 118D for all intermediate layers and end layer 62. In other embodiments, the second opening 112A, 112B, 112C, 112D can be of different second lengths 118A, 118B, 118C, 118D for different intermediate layers and the end layer 62, or different groups of intermediate layers, corresponding to different lengths of steps 52 of the stepped guide tab 34 as discussed further below. Similarly in other embodiments, the first opening 110A, 110B, 110C, 110D can be of different second lengths 114A, 114B, 114C, 114D for different intermediate layers and the end layer 62, or different groups of intermediate layers, corresponding to different lengths of steps 52 of the stepped guide tab 34 as discussed further below.

In some embodiments, the first opening 110B of layers in the second group of intermediate layers 94 comprises a first length 114B and a first width 116B. The second opening 112 of the layers in the second group of intermediate layers 96 comprises a second length 118B greater than the first length 114A. The first opening 110C of the third intermediate layer 28 comprises a first length 114C. The second opening 112C of the third intermediate layer 96 comprises a second length 118C greater than the first length 114C. The first opening 110D of the fourth intermediate layer 98 comprises a first length 114D. The second opening 112D of the fourth intermediate layer 98 comprises a second length 118D greater than the first length 114D. In this embodiment, the first opening 110 is the same first length 114 for all intermediate layers across all of the groups of intermediate layers 92, 94, 96, 98. In this embodiment, the second opening 112 is the same second length 118 within the intermediate layers of a single particular group of the groups of intermediate layers 92, 94, 96, 98, corresponding to an equivalent length of a step in the stepped second guide tab 34 as discussed below. However the length of the second opening 112 differs across different groups of intermediate layers 92, 94, 96, 98, wherein the second length 118B of the second opening 112B of the second group of intermediate layers 94 is less than the second length 118A of the the second opening 112A of the first group of intermediate layers 92, the second length 118C of the second opening 112C of the third group of intermediate layers 96 is less than the second length 118B of the second opening 112B of the second group of intermediate layers 94, and the second length 118D of the second opening 112D of the fourth group of intermediate layers 98 is less than the second length 118C of the second opening 112C of the third group of intermediate layers 96.

In the embodiment shown in FIGS. 6-7, the first opening 110D of the end layer 62 comprises a first length 114D. The second opening 112D of the end layer 62 comprises a second length 118D greater than the first length 114D. In this manner, the end layer 62 conforms with the fourth group of intermediate layers 98. In other embodiments, the end layer 62 has first and second openings 110, 112 that do not conform in size to any other intermediate layer or group of intermediate layers.

In certain embodiments, the first opening 110 and the second opening 112 of the intermediate layers 70, 72, 74, 76, 78, 80, 82, 84, 86, 88, 90 and the end layer 62 are marked by a matching element 130. The matching element 130 may indicate which group 92, 94, 96, 98 an intermediate layer belongs to, and the matching element 130 may also correspond to a differentiated feature 132 on the corresponding step or portion of the first guide tab 32 and/or second stepped guide tab 34. In certain embodiments, each intermediate layer and end layer 62 may have different matching elements 130. In other embodiments, the intermediate layers within each group of intermediate layers 92, 94, 96, 98 may have the same matching elements 130, but the matching elements 130A, 130B, 130C, 130D (see FIG. 7) will be different between the groups of intermediate layers. In some embodiments, the matching element 130 includes a colored band surrounding at least one of the first opening 110 and second opening 112. In other embodiments, the matching element 130 can include a partial colored band, e.g. a band that does not completely surround each of the first opening 110 and second opening 112, or other matching elements 130 such as a pattern, a letter, a number, a symbol, a texture, etc. In the embodiment shown in FIGS. 6-7, the matching elements 130 are provided on both the front and back side of each of the intermediate layers 70, 72, 74, 76, 78, 80, 82, 84, 86, 88, 90, 62. In other embodiments, the matching elements 130 are provided on only the front side or only the back side of intermediate layers. Accordingly, a feature and benefit of some embodiments is marking elements 130 or other indication to help direct the sequence of assembly by, for example, matching certain other indicia on the first guide tab 32 and stepped second guide tab 34.

In some embodiments, the first intermediate layer 70, 72, 74, making up first group of intermediate layers 92, further comprises a matching element 130A that is a first band 130A. In certain embodiments, the first band 130A comprises a first color surrounding each of the first opening 110A and the second opening 112A of the first intermediate layer 70, 72, 74. In some embodiments, the second intermediate layer 76, 78, 80, making up second group of intermediate layers 94, further comprises a second band 130B. In certain embodiments, the second band 130B comprises a second color surrounding each of the first opening 110B and the second opening 112B of the second intermediate layer 76, 78, 80 wherein the second color is different from the first color.

In some embodiments, the third intermediate layer 82, 84, 86, making up third group of intermediate layers 96 further comprises a third band 130C. In certain embodiments, the third band 130C comprises a third color surrounding each of the first opening 110C and the second opening 112C of the third intermediate layer, wherein the third color is different from the first color and second color. In certain embodiments, the third color is different from the first color and the second color.

In some embodiments, the fourth intermediate layer 88, 90, and/or 62, making up fourth group of intermediate layers 98 further comprises a fourth band 130D. In certain embodiments, the fourth band 130D comprises a fourth color surrounding each of the first opening 110D and the second opening 112D of the fourth intermediate layer 76, 78, 80, 82, 84, 86, 88, 90, and/or 62 wherein the fourth color is different from the first color, second color, and third color. In certain embodiments, the fourth color is different from the third color.

In certain embodiments, each intermediate layer 70, 72, 74, 76, 78, 80, 82, 84, 86, 88, 90, and/or 62 comprises a label corresponding to the order in which the intermediate layers 70, 72, 74, 76, 78, 80, 82, 84, 86, 88, and/or 90 are intended to be fitted to the front plate 30. In certain embodiments, this label comprises a number, a letter, a symbol, or other demarcation of order.

Referring to FIGS. 8-13, in certain embodiments, the front plate 30 comprises a base plate 35 comprising a forward face 36 opposite a rear face 38, and extending from the base plate 35 are the at least one first guide tab 32 and the stepped second guide tab 34. In certain embodiments, the guide tabs 32, 34 can be unitary with, and extensions of the base plate 35 of the front plate 30. In some embodiments, the guide tabs 32, 34 are located on opposing sides of the base plate 35. In other embodiments, the guide tabs 32, 34 may be located on the same side of the front plate 30, or adjacent sides of the front plate 30.

Figure 13:
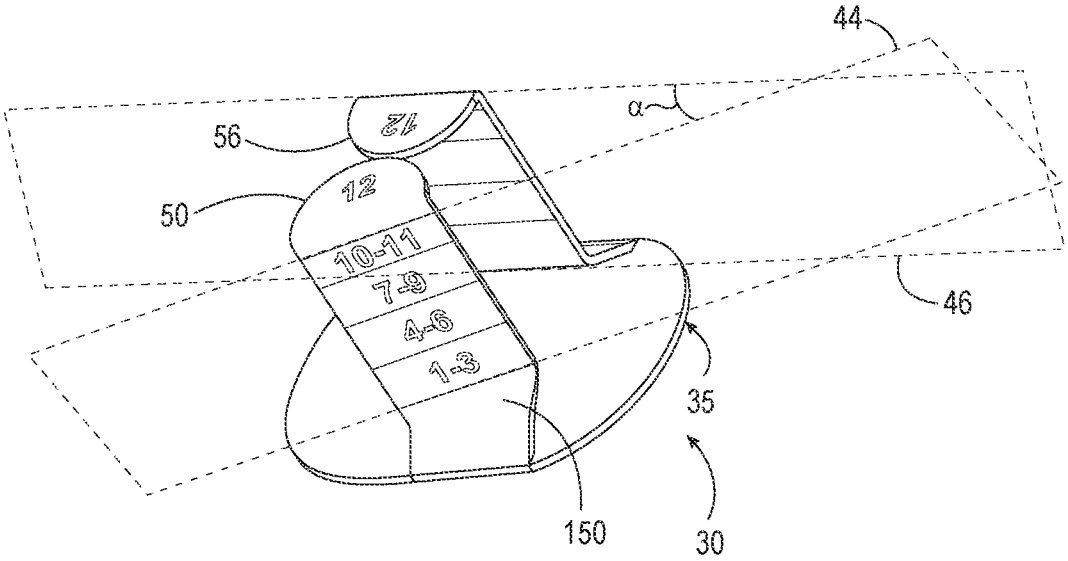

Certain embodiments include two guide tabs 32, 34. In certain embodiments, there are one, or three or more guide tabs 32, 34. In certain embodiments, the guide tabs 32, 34 are of substantially equal depths 40, 42 (shown in FIG. 8). In other embodiments, the depths 40, 42 are unequal. In certain embodiments, the guide tabs 32, 34 may be coplanar with the base plate 35. In other embodiments as shown in FIG. 13, the guide tabs 32, 34 comprise intersecting planes 44, 46 when bent 90 degrees from a plane of the base plate 35, the planes 44, 46 intersecting at the angle a. In embodiments, the guide tabs 32, 34 in this position lie substantially in the respective planes 44, 46.

In certain embodiments, the first guide tab 32 comprises a length 40 and a width 48 (FIG. 10) substantially equal to the first length 114 and first width 116 of the first openings 110 of the intermediate layers and end layer 62. In certain embodiments, "substantially equal" can mean within 0% to about 5% of a reference length, while configured to allow insertion of a guide tab 32, 34 into a respective opening. In other embodiments, the length 40 (along with step lengths 54A, 54B, 54C, 54D as discussed below) and width 48 of each guide tab 32, 34 at each relevant location is configured to fit tightly within the respective opening 110 or 112, such that the corresponding layers of the plurality of unitary layers 60 have minimal or no ability to shift or "play" when mounted on the guide tabs 32, 34. In some embodiments, this may be accomplished by a tight tolerance between the length and width of the guide tabs 32, 34 and respective openings, and also the relative angle a of the first guide tab 32 and second guide tab 34 (FIG. 13), and the corresponding angle a between the first opening 110 and second opening 112 (FIG. 6). In this manner, if there is any play along a first axis defined by the first opening 110 (e.g., a first axis along the length 114 or the width 116 of the first opening 110), such movement is counteracted by the interference between the second guide tab 34 in the second opening 112, provided by the second opening 112 being angled relative to the first opening 110, such as being angled at angle a shown in FIG. 6. Such movement is also counteracted by a tight fit provided by a width of the second guide 34 tab being substantially equal to a width of the corresponding second opening 112. In certain embodiments, the first guide tab 32 has a largely consistent length 40 in an area between the base plate 35 and an end portion 50. In embodiments, the first guide tab 32 has differentiated features 132 along the length 40 that correspond to matching element 130 of the first openings 110 of the intended corresponding layer while not corresponding to the first openings 110 of the other layer(s) Accordingly, a feature and benefit of some embodiments is a front plate that incorporates tabs providing multiple functions, including securing the layers together, and also preventing relative movement between the layers.

In certain embodiments, the stepped second guide tab 34 comprises a first step 52A and a second step 52B. In embodiments, the first step 52A and the second step 52B have differentiated features 132 that correspond to matching element 130 of the second openings 112 of the intended corresponding layer while not corresponding to the second openings 112 of the other layer(s). In some embodiments, the differentiated feature 132 includes a colored zone 134, such as first color zone 134A, second color zone 134B, third color zone 134C, fourth color zone 134D, and a fifth color zone 134E on the end portion 56. In embodiments, the differentiated feature surrounds at least one side of the first guide tab 32 or second stepped guide tab 34. In other embodiments, the differentiated feature 132 can include a partial zone or colored band, e.g. a band that does not cover each side of the first guide tab 32 or second stepped guide tab 34, or other differentiated features 132 such as a pattern, a letter, a number, a symbol, a texture, etc. In the embodiment shown in FIGS. 6-7, the differentiated features 132 are provided on both the front and back side of each of the first guide tab 32 or second stepped guide tab 34. In other embodiments, the differentiated features 132 are provided on only the front side or only the back side of the first guide tab 32 or second stepped guide tab 34. In still further embodiments, the differentiated features 132 match corresponding to certain marking elements 130 of the guide tabs.

In certain embodiments, the first step 52A comprises a length 54A substantially equal to the second length 118A of the second opening 112A of the first intermediate layer 70, 72, 74, and has a first differentiated feature 132 corresponding to matching element 130A. In certain embodiments, the second step 52B comprises a length 54B substantially equal to the second length 118B of the second opening 112B of the second intermediate layer 76, 78 and has a second differentiated feature corresponding to matching element 130B In certain embodiments, the third step 52C comprises a length 54C substantially equal to the second length 118C of the second opening 112C of the third intermediate layer 80, 82, 84 and has a third differentiated feature corresponding to matching element 130C. In certain embodiments, the fourth step 52D comprises a length 54D substantially equal to the second length 118D of the second opening 112D of the fourth intermediate layer 88, 90 and has a fourth differentiated feature corresponding to matching element 130D.

In certain embodiments, the second step 52B comprises a length 54B substantially equal to the second length 118 (e.g., 118B) of the second opening 112 (e.g., 112B) of the second intermediate layer 76, 78, 80.

In certain embodiments, the stepped second guide tab 34 comprises a third step 52C comprising a length 54C substantially equal to a second length 118C of the second opening 112C of the third group of intermediate layers 96.

In certain embodiments, the stepped second guide tab 34 comprises a fourth step 52D comprising a length 54D substantially equal to a second length 118D of second opening 112D of the fourth group of intermediate layers 98.

In some embodiments, there may be certain benefits of having a stepped guide tab 34. One such benefit is that the decreasing lengths of the openings and steps allows the plurality of unitary layers 60 to grow smaller as approaching the end layer 62, where the smaller intermediate layers 70, 72, 74, 76, 78, 80, 82, 84, 86, 88, and/or 90 may not be able to accommodate the larger openings 112 of the previous, larger layers 70, 72, 74, 76, 78, 80, 82, 84, 86, 88, and/or 90. Another benefit is that the different lengths of openings 112 and steps 54 allows the unitary layers 70, 72, 74, 76, 78, 80, 82, 84, 86, 88, and/or 90 to be more easily matched and stacked in the correct order by the user. In other words, if the length of the opening 112 in an intermediate layer 70, 72, 74, 76, 78, 80, 82, 84, 86, 88, and/or 90 and the next step 54 on the stepped second guide 34 do not match, then it indicates that the user is stacking the intermediate layers 70, 72, 74, 76, 78, 80, 82, 84, 86, 88, and/or 90 in the wrong order. In the same manner, in certain embodiments the differentiated feature 132 corresponding to matching element 130 of the corresponding second opening of the corresponding intermediate layer. Accordingly, a feature and benefit of some embodiments is steps incorporated into one or more of the guide tabs, the steps being sized to correspond with one or more particular layers of the model, such that the steps help to ensure that the proper sequence of layers is assembled.

In certain embodiments, when the model 20 is assembled, the first guide tab 32 and the stepped second guide tab 34 are configured to be bent at an angle β (FIG. 5) of 90 degrees from the base plate 35, with the stepped second guide tab 34 and the first guide tab 32 further comprising a depth 40, 42 configured to simultaneously extend through the openings 110, 112 of the plurality of intermediate layers 64 and the end layer 62 while also providing respective end portions 50, 56 of the guide tabs 32, 34 extending beyond the end layer 62. In this embodiment, the openings 110, 112 form right angles with the corresponding layer and are aligned to overlap allow the 90 degree angle. In other embodiments, the first guide tab 32 and the stepped second guide tab 34 are configured to be bent at angle β of approximately 90 degrees from the base plate 35. In still other embodiments, the first guide tab 32 and the stepped second guide tab 34 are configured to be bent at an angle β from the base plate 35 corresponding to an angle formed by the respective first and second openings 110, 112 of the intermediate layers, wherein at least one of the first openings and second openings of such intermediate layers do not form an axis 90 degrees from the base plate 35. In those embodiments, such axis may comprise an angle from 10 to 90 degrees.

In certain embodiments, the front plate 30 further comprises a first arm 150 and a second arm 152. In certain embodiments, the first arm 150 is located between the base plate 35 and the first guide tab 32. In certain embodiments, the second arm 152 is located between the base plate 35 and the stepped second guide tab 34. In certain embodiments, when the first guide tab 32 and stepped second guide tab 34 are bent 90 degrees from the base plate 35, and the first arm 150 and second arm 152 are folded flush with the base plate 35, the first guide tab 32 lies substantially in a first plane 44 and the second guide tab 34 lies substantially in a second plane 46, the first and second planes intersecting at an angle α (FIG. 13) from about 10 degrees to about 90 degrees.

In embodiments, the first arm 150 of the front plate 30 comprises a first joint 154 between the first arm 150 and the front plate, and a second joint 156 between the first arm and the first guide tab 32. In embodiments, the second arm 152 of the front plate 30 comprises a first joint 158 between the second arm 152 and the front plate, and a second joint 160 between the second arm 152 and the stepped second guide tab 34. In embodiments, the first arm 150 can be bent at the first joint 154 and the first arm 150 can be bent at the second joint 156. In embodiments, the second arm 152 can be bent at the first joint 158 and the second arm 152 can be bent at the second joint 160. In embodiments, the first arm 150 and the second arm 152 can be bent at the first joint 154, 158 such that the first arm 150 is substantially flush with the base plate 35. In embodiments, the first arm 150 and the second arm 152 can be bent at the second joint 156, 160 such that the first guide tab 32 and the second guide tab 34 are substantially coplanar. In certain embodiments, the first arm 150 comprises a rectangle whereas the second arm 152 comprises a quadrilateral with two angles that do not comprise 90 degrees, causing the first guide tab 32 and stepped second guide tab to define intersecting planes (see FIG. 13) when the first arm 150 and second arm 152 are substantially flush with the front plate 30.

Certain embodiments include a locking mechanism 140 for securing the first guide tab 32 and the second guide tab 34, or the respective end portions 50, 56 thereof, to the end layer 62. By securing the end portions 50, 56 to the end layer 62, the plurality of unitary layers 60 can be fixed in a substantially stable formation. In the embodiment shown in FIGS. 1-7, the locking mechanism includes a sticker 63 configured to cover the end portions 50, 56 of the guide tabs 32, 34 after they are folded over on the end layer 62, fixing the end portions 50, 56 of the guide tabs 32, 34 substantially flat on the end layer 62. In certain embodiments, the end portions 50, 56 are fixed by a locking mechanism 140 comprising a staple, pins, clips, glue, and the like. Accordingly, a feature and benefit of some embodiments is guide tabs that help to hold the model together after serving to guide and locate layers during assembly. Another feature and benefit of some embodiments is end portions and/or a locking mechanism that hold the model together without extra materials or several additional assembly steps, for example without glue between the layers. Another feature and benefit of certain embodiments is that the front plate 36 includes integral guide tabs 32, 34 that both serve to guide and locate layers during assembly and secure the model together after assembly without the use of glue or any other way of binding each layer relative to each other. In other words, in certain embodiments, the model is constructed without binding the individual intermediate layers to each other, other than each intermediate layer being threaded onto guide tabs 32, 34.

In certain embodiments, the first openings 110 and second openings 112 of the end layer 62 and each intermediate layer 60 are configured to align, respectively, with the first guide tab 32 and stepped second guide tab 34 when the first guide tab 32 and stepped second guide tab 34 are bent 90 degrees from a plane of the base plate 35.

Figure 5:
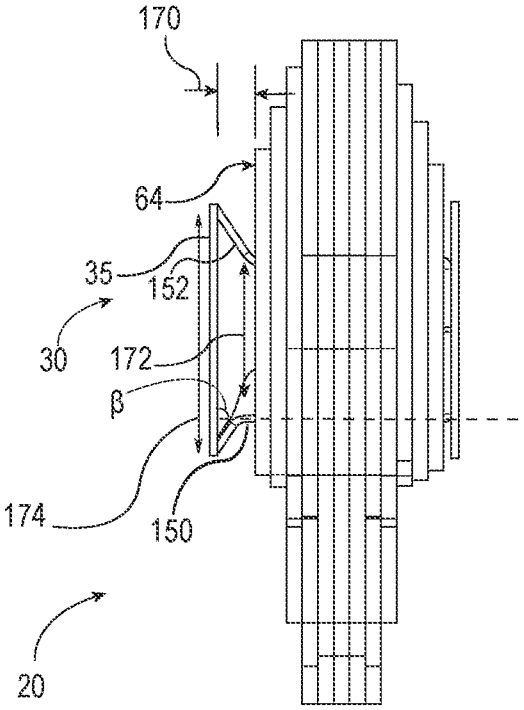
FIG. 5 is a side view of the model of FIG. 1.

In certain embodiments, when the front plate 30 is mounted to the first intermediate layer 70, the front plate 30 is separated by a gap 170. In certain embodiments, the gap 170, when viewed from a lateral side as shown in FIG. 5, comprises a quadrilateral formed by the first arm 150, the second arm 152, the front plate 30, and the first intermediate layer 70 of the plurality of intermediate layers 6. In certain embodiments, the gap 170 comprises other geometric shapes, e.g. a square, rectangle, rhomboid, etc. In certain embodiments, the gap 170 is equal to or greater than the thickness of the first intermediate layer 70 of the plurality of intermediate layers 64. In some embodiments, the gap 170 is formed by the first opening 110A and second opening 112A of the first intermediate layer 70, 72, 74, 76, 78, 80, 82, 84, 86, 88, and/or 90 having a minimum distance between that is less than the distance 172 between the first joint 154, 158 of the first arm 150 and second arm 152 (see FIGS. 5 and 13), which in effect retains the first intermediate layer at or rearward of the second joint 156, 160. Accordingly, a feature and benefit of some embodiments is a front plate that is spaced forward from the rest of the model and may be movable, providing 3-D aesthetics and additional playability, while securing the stack of intermediate layers at or rearward of the second joints 156, 160.

Figure 14:
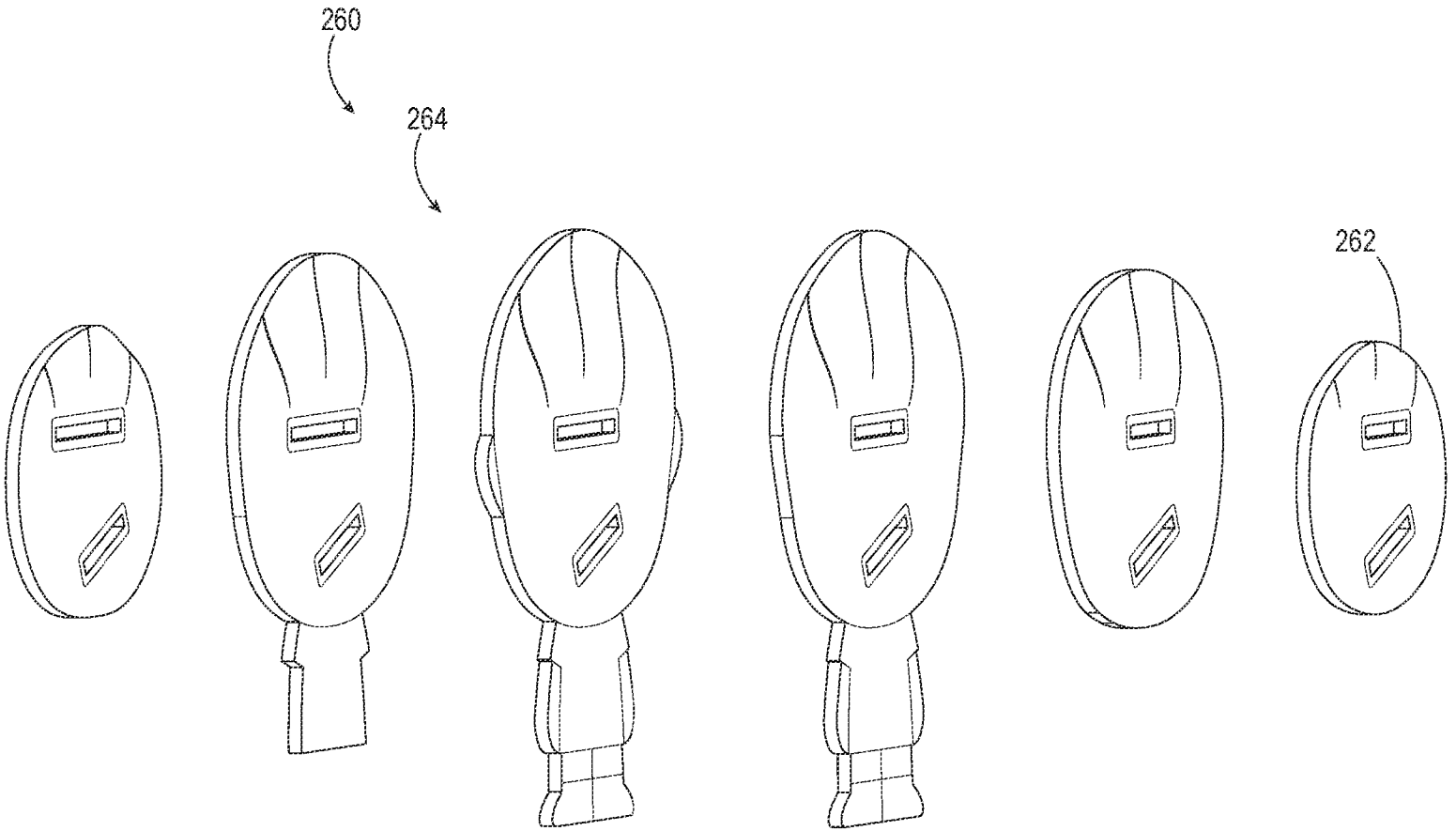
FIG. 14 is a rear perspective exploded view of a model according to embodiments of the present disclosure.

Referring to FIG. 14, another embodiment of the present disclosure is shown with a plurality of unitary layers 260 including a plurality of intermediate layers and an end layer 262. In this embodiment, the plurality of intermediate layers 264 comprises five layers.

Figure 15:
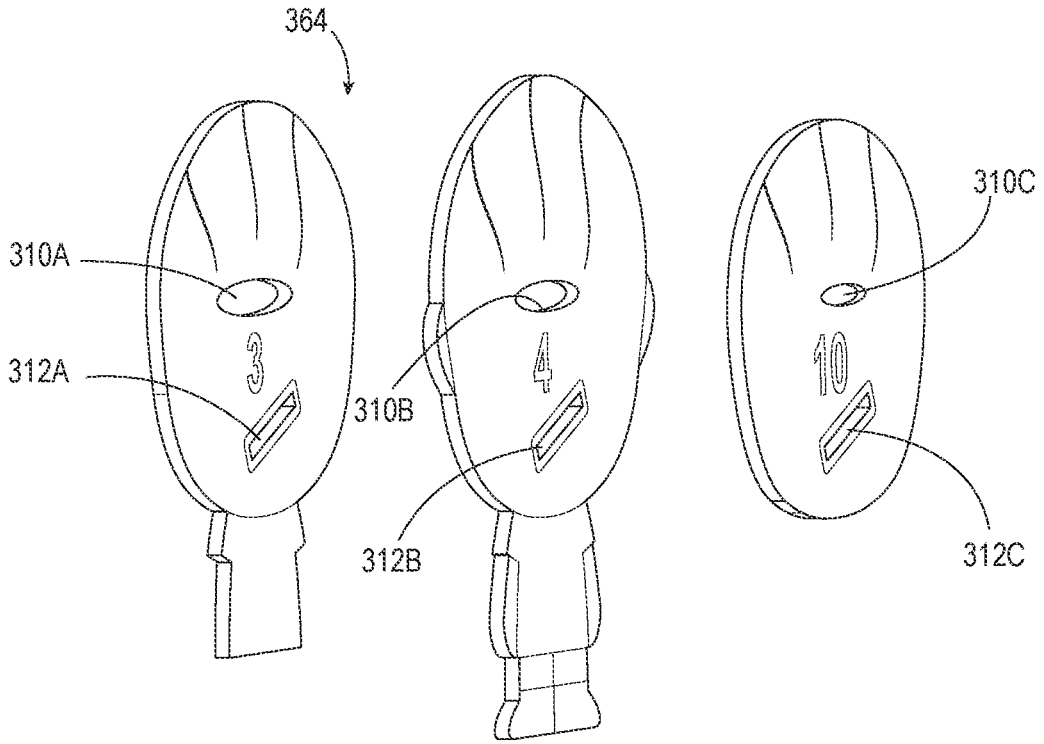
FIG. 15 is a rear perspective exploded view of a model according to embodiments of the present disclosure.

Referring to FIG. 15, another embodiment of the present disclosure is shown with a plurality of intermediate layers 364 successively having first openings 310A, 310B, 310C that are ovals and second openings 312A, 312B, 312C that are rectangles. The first openings 310A, 310B, 310C are of progressively decreasing length and width, while the second openings 312A, 312B, and 312C are of consistent size. In embodiments, the first and second openings 310, 312 may be any various shapes, e.g. straight, V-shape, U- shape, S-shape, W-shape, Z-shape, circular, square, rectangular, rhomboid, etc. In other embodiments, both the first openings 310 and the second openings 312 can have changing sizes (increasing or decreasing).

Figure 16:
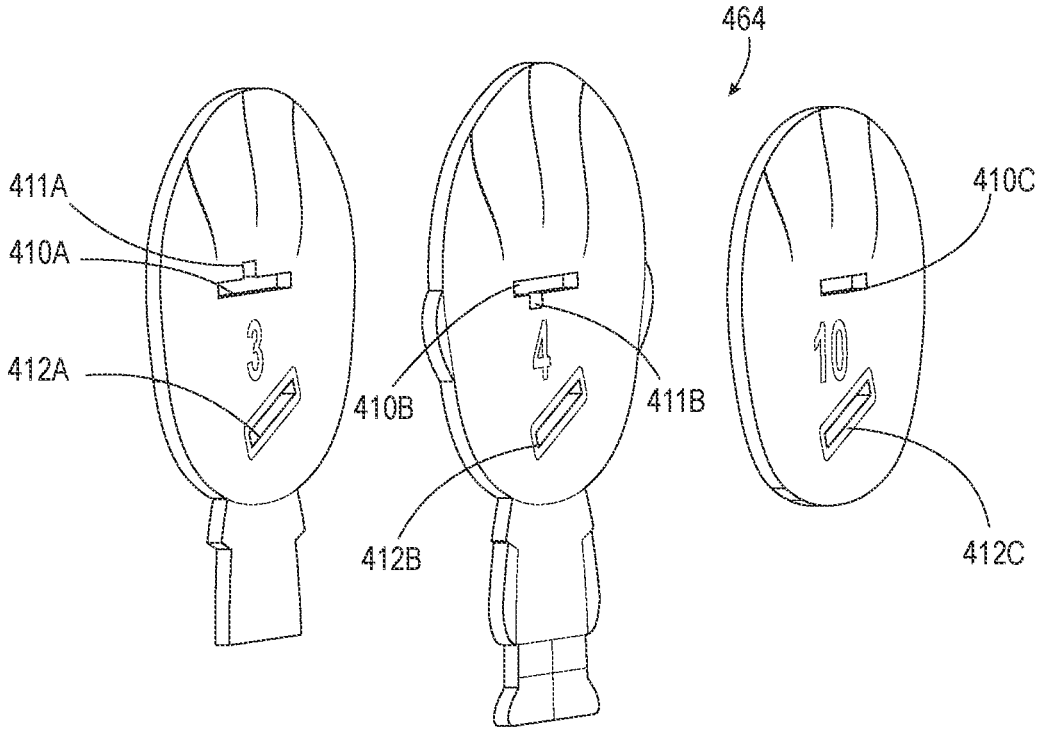
FIG. 16 is a rear perspective exploded view of a model according to embodiments of the present disclosure.

Referring to FIG. 16, another embodiment of the present disclosure is shown with a plurality of intermediate layers 464 successively having first openings 410A, 410B, 410C and second openings 412A, 412B, 412C. The first opening 410A has a notch 411A extending upward therefrom, and the first opening 410B has a notch 411B extending downward therefrom. The notches 411A, 411B can receive corresponding protrusions (not shown) extending from the first and second guide tabs 32, 34, to further improve alignment and fit. In other embodiments, each first opening 410 comprises a notch 411 at the same position. In still other embodiments, the notch can comprise a shape selected from semicircular, keyhole, triangular, rectangular, square, and the like.

In certain embodiments, the method for assembling the model 20 comprises preparing the front plate 30, mounting the plurality of unitary layers 60 on the front plate 30, and affixing the end portions 50, 56 of the first and second guide tabs 32, 34 to the end layer 62.

In certain embodiments, the step of preparing the front plate 30 comprises bending the first guide tab 32 and bending the stepped second guide tab 34. In certain embodiments, both guide tabs 32, 34 are bent to positions forming 90 degree angles from a plane of the front plate 30. In other embodiments, the guide tabs 32, 34 are bent to angles other than 90 degrees. In other embodiments, both guide tabs 32, 34 are bent to positions forming different angles from one another.

In certain embodiments, the step of bending the first guide tab 32 comprises the steps of bending the arm 150 at the first joint 154 of the first arm 150, positioning the first arm 150 flush with the front plate 30, bending the first arm 150 at the second joint 156, bending the second arm 152 at the first joint 158, positioning the second arm 152 flush with the base plate 35, and bending the second arm 152 at the second joint 160 of the second arm 152. While the intermediate layers are mounted, the first arm 150 and second arm 160 may remain flush with the base plate 35. However, in certain embodiments, the first joints and second joints 154, 158 of the first arm and second arm are configured to be resilient, such that after assembly the first arm and second arm do not remain flush with the base plate.

In certain embodiments, the first guide tab 32 and second guide tab 34 are preformed to have the first arm 150 and second arm 152, respectively, to be affixed flush with the base plate 35. In certain embodiments, the first arm 150 and second arm 152 are not positioned to be flush with the base plate 35.

In certain embodiments, the step of mounting the plurality of unitary layers 60 on the front plate 30 comprises threading the first guide tab 32 through the first opening 110A of the first intermediate layer 70, 72, 74, 76, 78, 80, 82, 84, 86, 88, and/or 90, threading the stepped second guide tab 34 through the second opening 112A of the first intermediate layer 70, 72, 74, 76, 78, 80, 82, 84, 86, 88, and/or 90, sliding the first intermediate layer 70, 72, 74, 76, 78, 80, 82, 84, 86, 88, and/or 90 until the matching elements 130, e.g. bands 130A comprising the first color match the first differentiated feature of the first guide tab 32 and the first differentiated feature of the stepped second guide tab 34.

In certain embodiments, the step of mounting the plurality of unitary layers 60 on the front plate 30 comprises threading the first guide tab 32 through the first opening 110B of the second intermediate layer 70, 72, 74, 76, 78, 80, 82, 84, 86, 88, and/or 90, threading the stepped second guide tab 34 through the second opening 112B of the second intermediate layer 70, 72, 74, 76, 78, 80, 82, 84, 86, 88, and/or 90, sliding the second intermediate layer 70, 72, 74, 76, 78, 80, 82, 84, 86, 88, and/or 90 until the bands 130B comprising the second color match the second differentiated feature 132, 134A of the first guide tab 32 and the second differentiated feature 132, 134B of the stepped second guide tab 34.

In certain embodiments, the step of mounting the plurality of unitary layers 60 on the front plate 30 comprises threading the first guide tab 32 through the first opening 110C of the third intermediate layer 70, 72, 74, 76, 78, 80, 82, 84, 86, 88, and/or 90, threading the stepped second guide tab 34 through the second opening 112C of the third intermediate layer 70, 72, 74, 76, 78, 80, 82, 84, 86, 88, and/or 90, sliding the third intermediate layer 70, 72, 74, 76, 78, 80, 82, 84, 86, 88, and/or 90 until the bands 130C comprising the third color match the third differentiated feature 132, 134C of the first guide tab 32 and the third differentiated feature 132, 134D of the stepped second guide tab 34.

In certain embodiments, the step of mounting the plurality of unitary layers 60 on the front plate 30 comprises threading the first guide tab 32 through the first opening 110D of the fourth intermediate layer 70, 72, 74, 76, 78, 80, 82, 84, 86, 88, and/or 90, threading the stepped second guide tab 34 through the second opening 112D of the fourth intermediate layer 70, 72, 74, 76, 78, 80, 82, 84, 86, 88, and/or 90, sliding the fourth intermediate layer 70, 72, 74, 76, 78, 80, 82, 84, 86, 88, and/or 90 until the bands 130D comprising the fourth color match the fourth differentiated feature 132, 134D of the first guide tab 32 and the second differentiated feature of the stepped second guide tab 34.

In certain embodiments, the step of mounting the plurality of unitary layers 60 on the front plate 30 occurs before the front plate 30 is prepared.

In certain embodiments, the step of affixing the end portions 50, 56 to the end layer 62 comprises the steps of bending the end portion 50 of the first guide tab 32 to be substantially flat with the end layer 62, bending the end portion 56 of the second guide tab 34 to be substantially flat with the end layer 62, and affixing the locking mechanism 140, e.g. sticker 63 over the end portions 50, 56 in a way that maintains the end portions 50, 56 in a flush configuration with the end layer 62.

In certain embodiments, the step of affixing the end portions 50, 56 to the end layer 62 comprises the step of latching the end portions 50, 56 to one another. In certain embodiments, the step of affixing the end portions 50, 56 to the end layer 62 comprises attaching the end portions 50, 56 to one another with a staple. In certain embodiments, the step of affixing the end portions 50, 56 to the end layer 62 comprises gluing the end portions 50, 56 to one another.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed. In examples, the model may have arms and guide tabs extending from a rear plate or an individual layer instead of the front plate.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A model comprising:

a plurality of unitary layers comprising:

an end layer comprising a first opening and a second opening, and a plurality of intermediate layers, comprising:

a first intermediate layer, comprising:

a first opening comprising a first length, a second opening comprising a second length greater than the first length, and a first band comprising a first color surrounding each of the first opening and the second opening;

a second intermediate layer, comprising:

a first opening comprising the first length, a second opening comprising a second length that is less than the second length of the first intermediate layer, the second length of the second intermediate layer being equal to or longer than the first length thereof, and a second band comprising a second color surrounding each of the first opening and the second opening of the second intermediate layer;

a front plate, comprising:

a base plate, a first guide tab comprising a length substantially equal to the first length, a stepped second guide tab, comprising:

a first step, comprising:

a length substantially equal to the second length of the second opening of the first intermediate layer, and the first color;

a second step, comprising:

a length substantially equal to the second length of the second opening of the second intermediate layer, and the second color;

the first guide tab and the stepped second guide tab configured to be bent 90 degrees from a plane of the front plate, the first guide tab and the stepped second guide tab further comprising a depth configured to simultaneously extend through the openings of the plurality of intermediate layers and the end layer while also providing end portions of the guide tabs extending beyond the end layer; and a sticker configured to cover the end portions of the guide tabs after they are folded over on the end layer, fixing the end portions of the guide tabs substantially flat on the end layer;

wherein the first and second openings of the end layer and each intermediate layer are configured to align, respectively, with the first guide tab and stepped second guide tab when the first guide tab and stepped second guide tab are bent 90 degrees from the plane of the front plate.

2. The model of claim 1, wherein a forward face of the front plate depicts a face of a character.

3. The model of claim 1, wherein the first guide tab extends from the front plate and stepped second guide tab extends from the front plate such that when bent 90 degrees from a plane of the front plate, the first guide tab and the stepped second guide tab define intersecting planes.

4. The model of claim 3, wherein the front plate further comprises:

a first arm located between the base plate and the first guide tab, the first arm comprising:

a first joint between the first arm and the front plate, and a second joint between the first arm and the first guide tab, and a second arm located between the base plate and the stepped second guide tab, the second arm comprising:

a first joint between the second arm and the front plate, and a second joint between the second arm and the stepped second guide tab.

5. The model of claim 4, wherein, when the first guide tab and stepped second guide tab are bent 90 degrees from the plane of the front plate, and the first arm and second arm are folded flush with the front plate, the first arm lies substantially in a first plane and the second arm lies substantially in a second plane, the first and second planes intersecting at an angle from about 10 degrees to about 90 degrees.

6. The model of claim 4, wherein, when the front plate is attached to the first intermediate layer, the front plate is separated by a gap from the first intermediate layer, the gap comprising a quadrilateral formed by the first arm, the second arm, the front plate, and the first intermediate layer.

7. The model of claim 6, wherein the gap is equal to or greater than the thickness of the first intermediate layer.

8. The model of claim 1, wherein the plurality of intermediate layers further comprises:

a third intermediate layer comprising:

a first opening comprising the first length, a second opening comprising a second length greater than the first length, and a third band comprising a third color surrounding each of the first opening and the second opening.

9. The model of claim 8, wherein the stepped second guide tab further comprises:

a third step, comprising:

a length substantially equal to the second length of the second opening of the third intermediate layer, and the third color.

10. The model of claim 8, wherein the plurality of intermediate layers further comprises:

a fourth intermediate layer comprising:

a first opening comprising the first length, a second opening comprising a second length greater than the first length, and a fourth band comprising a fourth color surrounding each of the first opening and the second opening.

11. The model of claim 10, wherein the stepped second guide tab further comprises a fourth step, comprising:

a length substantially equal to the second length of the second opening of the fourth intermediate layer, and the fourth color.

12. The model of claim 1, wherein the plurality of unitary layers comprises at least ten unitary layers.

13. The model of claim 1, wherein the first guide tab comprises a constant length up to the end portion of the first guide tab.

14. A method of assembling a model comprising the steps of:

preparing a front plate comprising the steps of:

bending a first guide tab of the front plate to a position forming a 90 degree angle from a plane of a base plate of the front plate, the first guide tab comprising a first length; and bending a stepped second guide tab of the front plate to a position forming a 90 degree angle from the plane of the front plate, the stepped second guide tab comprising a first step comprising a first length and the first color and a second step comprising a second length;

mounting a plurality of unitary layers on the front plate, wherein the plurality of unitary layers comprises a first intermediate layer comprising a first opening of a first length substantially equal to the first length of the first step, a second opening of a second length substantially equal to the second length of the second length, and a first band comprising a first color, wherein mounting a plurality of unitary layers on the front plate comprises:

threading the first guide tab through the first opening of the first intermediate layer;

threading the stepped second guide tab through the second opening of the first intermediate layer;

sliding the first intermediate layer toward the front plate along the first guide tab and stepped second guide tab;

the plurality of unitary layers comprising a second intermediate layer, comprising a first opening of a first length substantially equal to the first length of the first intermediate layer, a second opening of a second length substantially equal to the second length of the second step, the mounting the plurality of unitary layers on the front plate further comprising:

threading the first guide tab through the first opening of the second intermediate layer, threading the stepped second guide tab through the second opening of the second intermediate layer, and sliding the first intermediate layer along the first guide tab and stepped second guide tab, wherein the plurality of unitary layers further comprises an end layer, comprising a first opening of a length substantially equal to the first length and a second opening, the mounting a plurality of unitary layers on the front plate further comprising:

threading the first guide tab through the first opening of the end layer, and threading the stepped second guide tab through the second opening of the end layer;

bending an end portion of the first guide tab to be substantially flat with the end layer, bending an end portion of the stepped second guide tab to be substantially flat with the end layer;

affixing the end portion of the first guide tab and the end portion of the stepped second guide tab in a way that maintains the end portions in a flush configuration with the end layer.

15. The method of claim 14, wherein the first guide tab and stepped second guide tab define intersecting planes when bent 90 degrees from the front plate.

16. The method of claim 14, wherein the front plate further comprises:

a first arm located between the base plate and the first guide tab, the first arm comprising:

a first joint between the first arm and the front plate, and a second joint between the first arm and the first guide tab, and a second arm located between the front plate and the stepped second guide tab, the second arm comprising:

a first joint between the second arm and the front plate, and a second joint between the second arm and the stepped second guide tab, wherein the step of preparing the front plate further comprises:

bending the first arm at the first joint;

positioning the first arm flush with the front plate;

bending the first arm at its second joint;

bending the second arm at its first joint;

positioning the second arm flush with the front plate; and bending the second arm at its second joint.

17. The method of claim 14, the first guide tab further comprising a third color zone comprising a third color and the stepped second guide tab further comprising a third step comprising a third length.

18. The method of claim 17, wherein the plurality of unitary layers further comprises a third intermediate layer, comprising a first opening of a first length substantially equal to the first length of the first intermediate layer, a second opening of a second length substantially equal to the third length of the third step, and a third band comprising the third color, and wherein mounting the plurality of unitary layers on the front plate further comprises:

threading the first guide tab through the first opening of the third intermediate layer;

threading the stepped second guide tab through the second opening of the third intermediate layer; and sliding the third intermediate layer along the first guide tab and stepped second guide tab.

19. The method of claim 18, the stepped second guide tab further comprising a fourth step comprising a fourth length.

20. The method of claim 19, wherein the plurality of unitary layers further comprises a fourth intermediate layer, comprising a first opening of a first length substantially equal to the first length of the first intermediate layer, a second opening of a second length substantially equal to the fourth length of the fourth step, and a fourth band comprising the fourth color, mounting the fourth intermediate layer, comprising:

threading the first guide tab through the first opening of the fourth intermediate layer;

threading the stepped second guide tab through the second opening of the fourth intermediate layer;

sliding the fourth intermediate layer along the first guide tab and second stepped guide tab.

* * * * *